US005427272A

United States Patent [19]

Gaspari

[11] Patent Number: 5,427,272

[45] Date of Patent: Jun. 27, 1995

[54] TANK AND HOSE CARRYING CASE

[76] Inventor: Albert Gaspari, 2301 Larkin Rd., Boothwyn, Pa. 19061

[21] Appl. No.: 279,689

[22] Filed: Jul. 25, 1994

Related U.S. Application Data

[63] Continuation of Ser. No. 21,958, Feb. 18, 1993, abandoned.

[51] Int. Cl.[6] ..... B65D 85/04

[52] U.S. Cl. ..... 220/737; 220/724; 220/23.83; 222/183

[58] Field of Search ..... 248/311.2; 220/724, 220/737, 740, 506, 571, 23.83, 23.86, 505, 503, 739, 728, 727, 726, 725, 506; 222/183

[56] References Cited

U.S. PATENT DOCUMENTS

| | | | |
|---|---|---|---|
| 664,117 | 12/1900 | Bates | 220/506 |
| 1,742,066 | 12/1929 | Gardner | 220/737 |
| 2,265,172 | 12/1941 | Katz | 220/506 |
| 2,327,447 | 8/1943 | O'Brien | 220/506 |
| 2,384,174 | 9/1945 | Jones | 222/176 |
| 2,725,208 | 5/1952 | Bova | 248/89 |
| 2,757,953 | 8/1956 | Bussey et al. | 299/30 |
| 2,871,057 | 1/1959 | Bernyk | 299/78 |
| 3,197,066 | 7/1965 | Denzler et al. | 222/183 |
| 3,342,369 | 9/1967 | Randolf | 220/501 |
| 3,887,069 | 6/1975 | Diwo | 220/23.86 |
| 4,071,163 | 1/1978 | Martin | 220/737 |
| 4,501,533 | 2/1985 | Bower, Jr. | 222/183 |
| 4,506,853 | 3/1985 | Cathey | 248/79 |
| 4,573,665 | 3/1986 | Strohl et al. | 266/48 |
| 4,588,083 | 5/1986 | Hunt | 206/389 |
| 4,625,949 | 12/1986 | Walker | 266/48 |
| 4,905,855 | 3/1990 | Troiano et al. | 220/724 |
| 5,011,034 | 4/1991 | Abel | 220/23.86 |
| 5,209,348 | 5/1993 | Schafer, III | 220/506 |

FOREIGN PATENT DOCUMENTS

| | | | |
|---|---|---|---|
| 1120882 | 7/1956 | France | 220/724 |

*Primary Examiner*—Stephen J. Castellano
*Attorney, Agent, or Firm*—Alfred Stapler; Lipton & Stapler

[57] ABSTRACT

A storage structure for a cylindrical tank and its attached dispensing hose is formed by two concentric cylinders, the inner holding the tank, the outer holding the hose coiled between it and the tank.

10 Claims, 1 Drawing Sheet

TANK AND HOSE CARRYING CASE

This is a continuation of application Ser. No. 08/021,958 filed on Feb. 18, 1993, now abandoned.

BACKGROUND OF THE INVENTION

The invention relates to apparatus for supporting a fluid-containing tank and its attached dispensing hose in a manner which makes it exceptionally easy and convenient to store both tank and hose, as well as to remove one or both from such stored condition, and even to transport them while stored.

A commonly used item in various pursuits consists of an elongated, cylindrical tank which contains (or is adapted to contain) a fluid such as acetylene, for example, and a hose through which this fluid is to be dispensed. Such a tank is typically a foot and a half or so high, and six to eight inches in diameter. The hose connection is typically made at one end of the cylinder. While the hose can be detached when not in use, this is rarely done unless the tank is to be out of use for an extended period of time. Far more commonly, the hose is left attached to the tank between uses and even while it is being moved from place to place between uses.

The problem which this creates is how to store the hose while not in use but still attached to the tank. What makes this problem even more acute is the fact that such a hose is often quite long, lengths of two or three feet, or even more being not uncommon. It is also usually quite flexible. Together, this gives rise to a kind of "tail", which dangles from the tank connection and which is extremely awkward to deal with. A further complication arises from the fact that the fluids which are stored in such tanks and dispensed through the hose are often quite noxious (acetylene being a good example). Therefore, it becomes important that the dispensing hose be treated with care to prevent it from becoming damaged during storage and transportation and subsequently releasing unwanted fluid during use.

Perhaps the simplest way to deal with this situation has been to just coil up the hose and drape the resulting coil loosely over the projection which commonly exists at the connection between hose and tank. At that connection, there is often also a tank shut-off valve and/or gauge and this has provided additional or alternative support for the coiled hose. This primitive approach clearly left much to be desired. It provided no protection for the hose, it left the hose only poorly secured during transportation, it interfered with the operation of whatever valving or gauging was to take place at the tank-to-hose connection, etc.

More sophisticated approaches have also been proposed. These involved essentially providing special support structures for the hose adjacent to the tank. Several varieties of these are shown in the following U.S. Pat. Nos.: Bova 2,725,208; Bussey 2,757,958; Jones 2,384,174; Cathey 4,506,853; Strohl 4,573,665; Walker 4,625,949. No doubt there are still others as well. However, it is believed to be apparent that none of these solved all the various problems. In particular, none solved the problem of providing substantial protection for the hose. Several also remained subject to severe tangling, as shown most clearly in Strohl U.S. Pat. No. 4,573,665. All except perhaps Jones U.S. Pat. No. 2,384,174 did nothing to promote convenient transportation, and that one did so only at the sacrifice of accessibility to the tank-to-hose connection and control valve.

SUMMARY OF THE INVENTION

Accordingly it is an object of the present invention to provide apparatus of the general nature under discussion, but which is free of one or more of the problems which beset the relevant prior art.

It is another object to provide apparatus for storing a hose connected to one end of an elongated cylindrical tank, which apparatus protects both hose and tank, does not interfere with the tank-to-hose connection or the valving and gauging at that connection, promotes convenience in transporting both tank and hose, and generally improves the utilization of such a tank-and-hose assembly.

These and other objects which will appear are achieved in accordance with the invention by providing a structure which comprises two concentric cylinders, both open at the same end. The inner cylinder is of such diameter that the cylindrical tank fits within it, while the outer is of sufficiently greater diameter to enable the hose to be conveniently coiled within the annular space defined between the inner and outer cylinders.

Preferably, the outer cylinder is tall enough so that the tank, together with its hose connection and associated valving and gauging terminate below the top of the outer cylinder when the tank is inserted in the inner cylinder. On the other hand, the inner of the two concentric cylinders is preferably shorter than the outer, so as to enable convenient access to the tank's top and the hose connection and associated valving and gauging, even when the tank has been inserted in the inner cylinder. The annular space between the inner and outer cylinders is preferably equipped with a shelf, which forms an intermediate support within that space and on which there rests the bottom of the coil formed when the hose is stored in that annular space. By appropriately locating that shelf, one can restrict the annular space between cylinders which is available for coiled hose storage to that needed for the particular hose length in use, eliminating waste space and also minimizing the need to reach into that space farther than necessary to store the hose or to withdraw it for use.

BRIEF DESCRIPTION OF THE DRAWINGS

For further details, reference is made to the description which follows, in light of the accompanying drawings, wherein.

The same reference numerals are used in both figures to designate similar elements.

DETAILED DESCRIPTION OF THE PREFERRED EMBODIMENT

Figure 2:
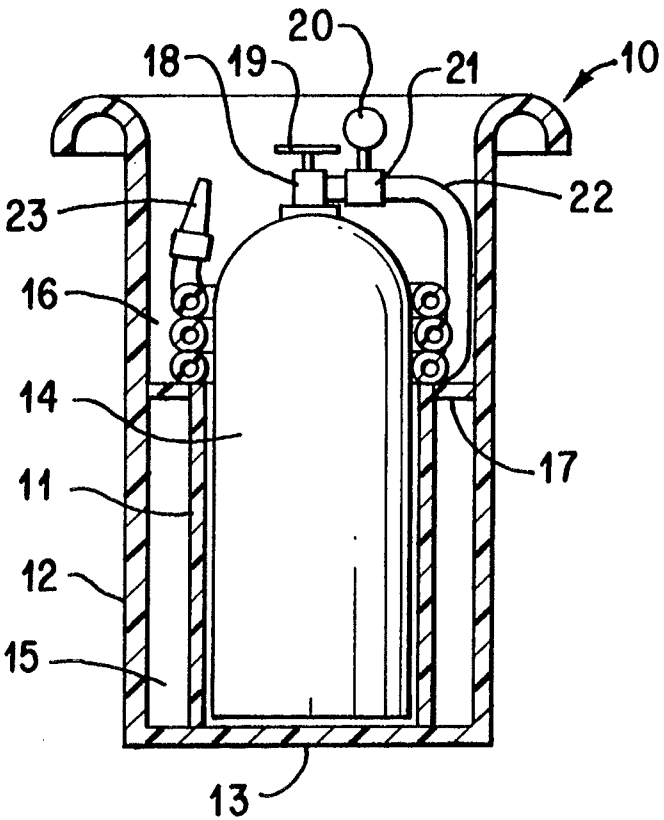
FIG. 2 is a view similar to FIG. 1, but which also shows in diagrammatic (non-cross-sectioned) form a tank and hose in cooperation with that apparatus.

Referring now to both Figures, reference numeral 10 designates the entire storage and support structure embodying the present invention. As can be seen, this comprises two concentric cylinders 11 and 12 which are both closed at the bottom and open at their respective upper ends. The inner cylinder 11 is proportioned so as to have a tank inserted into it and supported by its cylindrical sidewall while resting on the closed bottom 13.

This tank 14 is diagrammatically illustrated in FIG. 2, positioned as described.

The outer cylinder 12 is spaced apart from the inner cylinder 11, and is also substantially taller than that inner cylinder. In this way, there is defined an annular space 15 between the inner and outer cylinders, alongside inner cylinder 11, and also an annular space 16 (FIG. 2) between tank 14 and outer cylinder 12 above the end of inner cylinder 11. An annular shelf 17 closes the top of annular space 15 and essentially surrounds the open end of inner cylinder 11.

At the top of tank 14 (FIG. 2), there is the conventional tank outlet structure 18 with shut-off valve 19, gauge 20 and hose coupling 21. Hose 22 is attached to this hose coupling 21 and leads downwardly from that hose coupling 21 into space 16 between tank 14 and outer cylinder 12, ultimately resting on the top of annular shelf 17. Thence, the hose 22 is coiled around tank 14 upwardly within space 16, terminating in discharge nozzle 23.

All of structure 10 is preferably made of plastic material sufficiently thick and rigid so as not to deform when in use. In particular, this structure 10, together with the tank 14 and hose 22 assembly, shown in FIG. 2, can be used not only to store the tank and hose assembly, but also to carry it from place to place. The structure 10 needs to be sufficiently strong for such use. To facilitate such carrying and general handling, the open (top) end of outer cylinder 12 is preferably provided with a turned-over rim 24 by means of which the structure can be readily lifted and carried about.

Although shown in the drawings as solid members, the concentric cylinders 11 and 12, as well as shelf 17 may be made of perforated, or mesh-like material. This would tend to lighten the structure and would also make it more convenient to clean should dirt or debris settle within it. Such a change in structural material, however, should not diminish the strength and rigidity of the structure which needs to be such as to support the weight of the tank and hose assembly, as previously explained.

The internal dimensions of the structure 10 should be such as to accommodate the particular tank and hose combination for which it is to be used. Thus, the width of the annular space 16 between the upper portion of tank 14 and the outer cylinder 12 is preferably so selected that only a single layer of coiled hose can be formed within it. On the other hand, the vertical positioning of shelf 17 above bottom 13 should be such that the entire length of the hose will fit when coiled in a single layer within the portion of outer cylinder 12 extending above shelf 17. For clarity of illustration, the side walls of inner cylinder 11 are shown in FIG. 2 as slightly spaced away from tank 14. However, it will be understood that the fit between the walls of the tank and these side walls of inner cylinder 11 should be sufficiently snug so that the tank can be inserted and removed without difficulty, while still being solidly held in the position shown in FIG. 2, while inserted in that cylinder.

Figure 1:
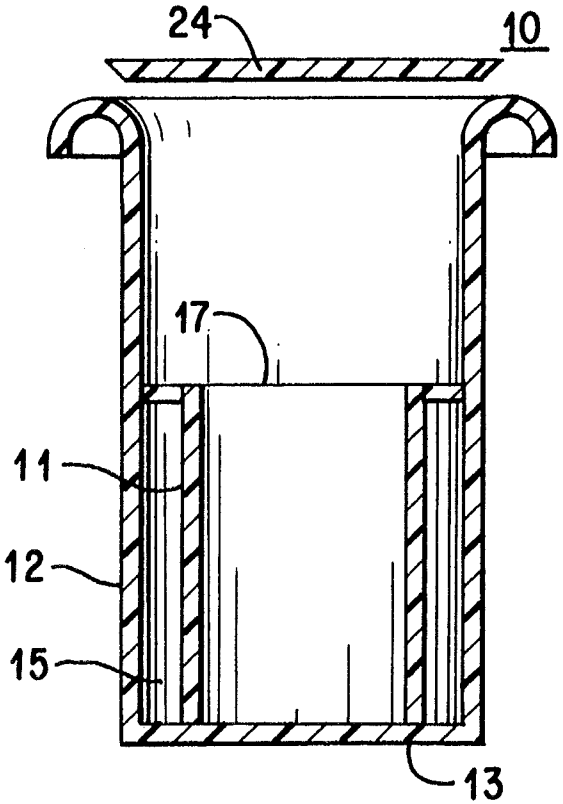
FIG. 1 is an elevational cross-section through tank-and-hose storage apparatus embodying the invention.

Many other variations are possible without departing from the concept of the present invention. For example, the vertical position of shelf 17 can be made adjustable so that different lengths of hose 22 can be accommodated by the invention. A lid 23 (FIG. 1) may be provided to rest upon the open top of cylinder 12, thereby providing further protection to the entire assembly. The elements 11 and 12 are not necessarily perfectly cylindrical. Rather, they should have the transverse configurations which are appropriate to match those of the tank with which they are to cooperate. Still other variations will occur to those skilled in the art within the inventive concept. Accordingly, it is desired that the scope of the invention be limited only by the appended claims.

I claim:

1. In combination, a generally cylindrical tank for holding fluid, a hose for dispensing the fluid attached to the tank, and an apparatus supporting and storing said tank and hose, said combination comprising the tank, hose and apparatus, wherein the apparatus includes inner and outer generally cylindrical structures attached coaxially to each other, and both open at the same end, the tank being positioned in the inner structure which conforms generally to the outer walls of the tank, the outer structure being spaced radially outward from said tank positioned in said inner structure and thereby providing an annular space, said hose being coiled in said angular space as a result of insertion through said open end of said outer structure.

2. The combination of claim 2 further comprising a radially extending shelf joining the inner and outer structures and limiting the depth of said annular space.

3. The combination of claim 2 wherein the depth of the annular space is as defined by the axial location of the shelf is such that the entire hose is coiled within the annular space.

4. The combination of claim 1 further comprising means at the end of the inner structure opposite its said open end for closing that structure so that the tank does not extend beyond that opposite end.

5. The combination of claim 4 wherein the inner structure is axially sufficiently long to support the tank in a substantially upright position.

6. The combination of claim 5 wherein the inner structure is axially substantially shorter than the outer structure and its said open end stops substantially short of the said open end of the outer structure.

7. The combination of claim 5 wherein the outer structure is axially sufficiently long to extend beyond the tank and any devices associated with the discharge end of the tank positioned in said inner structure.

8. The combination of claim 3 wherein the radial dimensions of the inner and outer cylindrical structures are such that only one layer of hose is coiled in said annular space.

9. The combination of claim 1 wherein the open end of said outer cylindrical structure comprises a rim which is turned over in such a manner that the combination can be readily picked up by means of said rim.

10. The apparatus of claim 9 further comprising a lid placed over said open end of said outer cylindrical structure.

* * * * *